United States Patent [19]

Rich

[11] 4,081,640

[45] Mar. 28, 1978

[54] COMPACT VACUUM SWITCH FOR HIGH VOLTAGE CIRCUIT INTERRUPTION

[75] Inventor: Joseph A. Rich, Schenectady, N.Y.

[73] Assignee: General Electric Company, Schenectady, N.Y.

[21] Appl. No.: 678,294

[22] Filed: Apr. 19, 1976

[51] Int. Cl.[2] ..... H01H 33/66

[52] U.S. Cl. ..... 200/144 B; 200/147 R

[58] Field of Search ..... 200/144 B, 147 R, 147 A

[56] References Cited

U.S. PATENT DOCUMENTS

| | | | |
|---|---|---|---|
| 3,008,022 | 11/1961 | Lee | 200/144 B |
| 3,082,307 | 3/1963 | Greenwood et al. | 200/144 B |
| 3,131,276 | 4/1964 | Watson | 200/144 B |
| 3,210,505 | 10/1965 | Porter | 200/144 B |
| 3,261,954 | 7/1966 | Yonkers | 200/144 B |
| 3,555,223 | 1/1971 | Robinson et al. | 200/144 B |
| 3,740,507 | 6/1973 | Kuhl et al. | 200/144 B |
| 3,914,568 | 10/1975 | Crouch et al. | 200/144 B |

FOREIGN PATENT DOCUMENTS

| | | | |
|---|---|---|---|
| 44-20693 | 1969 | Japan | 200/144 B |
| 45-20650 | 1970 | Japan | 200/144 B |

*Primary Examiner*—Robert S. Macon

*Attorney, Agent, or Firm*—Marvin Snyder; Joseph T. Cohen; Jerome C. Squillaro

[57] ABSTRACT

High interruption voltage capability within a vacuum switch of limited physical size is achieved by combining a diffuse arc electrode structure with provision for retracting one or both of a pair of movable butt contacts into an approximately field-free region. On separation of the contacts, an arc is initiated on the contacts and then transferred to a fixed gap electrode structure comprising a coaxial cylindrical electrode assembly in which the current path is folded back on itself to reduce the azimuthal magnetic field external to the outer cylindrical surface, causing the arc to burn in a diffuse mode over a greatly enlarged electrode surface area.

8 Claims, 10 Drawing Figures

8
20
40
14
22
12
10
11
24
42
35
34
32
30
38
16
39
31
2
2
36
37
33
25
43
13
23
15
41
21
9

COMPACT VACUUM SWITCH FOR HIGH VOLTAGE CIRCUIT INTERRUPTION

INTRODUCTION

This invention relates to vacuum arc discharge devices, and more particularly to vacuum switches in which high voltage interruption capability is achieved by allowing arc transfer from butt contacts to a fixed gap, coaxial electrode assembly in which the current path is folded back on itself to reduce the azimuthal magnetic field external to the outer cylindrical surface.

Vacuum arc discharge devices of the type described and claimed in J. A. Rich U.S. Pat. No. 3,854,068, issued Dec. 10, 1974 and assigned to the instant assignee have a large arc interruption capability. However, physical size of the vacuum container for such apparatus may be too large for some applications. Hence it is desirable to achieve a reduction in vacuum switch physical size without excessively reducing vacuum switch current interruption capability.

A vacuum switch containing a natural cavity into which the movable electrodes can be retracted is advantageous in that retraction of one or both hot butt contacts leads to an enhanced ability to hold off voltage after current zero has occurred. A vacuum interrupter in which a single butt contact is retracted into a high dielectric strength shield when the contacts are parted is described and claimed in L. P. Harris application Ser. No. 589,516, filed June 23, 1975, now patent No. 3997,748, issued Dec. 14, 1976 and assigned to the instant assignee, while Crouch et al. U.S. Pat. No. 3,914,568, issued Oct. 21, 1975 and also assigned to the instant assignee, concerns a vacuum switch in which each of the butt contacts is retracted into a shielded, low field intensity region when the contacts are parted.

The present invention concerns vacuum discharge apparatus in which the arc, initiated on the butt contacts when they are opened, transfers to a fixed gap electrode assembly comprising a coaxial cylindrical electrode into which a respective butt contact is retracted when the contacts part. The arc thus extends from one cylindrical electrode to the other. By folding the cylindrical electrode structure back on itself so as to reduce the azimuthal magnetic field external to its outer cylindrical surface, the arc tends to burn in a diffuse mode over a much enlarged electrode surface area. In this fashion, the fixed gap electrode assembly is capable of handling large arcing currents without suffering damage.

Accordingly, one object of the invention is to provide a compact vacuum switch capable of withstanding high interruption voltages.

Another object is to provide a vacuum switch having a fixed gap electrode structure in which an arc tends to burn in a diffuse mode over a large portion of the electrode surface area.

Another object is to provide a vacuum switch having a fixed gap structure capable of creating a magnetic field having a radial component in the gap region of sufficient strength to rotate arc plasma in the gap.

Briefly, in accordance with a preferred embodiment of the invention, a vacuum discharge device comprises a hermetically sealed, evacuated envelope having first and second opposed, conductive end walls. First and second central butt contacts which abut each other when carrying normal load current are provided. The first butt contact is retractable toward the first end wall and is electrically connected thereto, and the second butt contact is electrically connected to the second end wall. First and second coaxial electrode assemblies are coaxially situated about the first and second butt contacts, respectively, and are electrically connected to the first and second end walls, respectively. The first butt contact is retractable into the first coaxial electrode assembly. The first and second coaxial electrode assemblies are fixedly separated from each other by a predetermined distance.

In accordance with another preferred embodiment of the invention, in a vacuum switch in which an arc initiated between first and second centrally-located butt contacts is transferred to first and second coaxial electrode assemblies surrounding the first and second butt contacts, respectively, when the butt contacts are separated, a method of creating a diffuse arc about each of the first and second coaxial electrode assemblies is provided. The method comprises the steps of situating the first and second butt contacts within the first and second coaxial electrode assemblies, respectively, such that each of the butt contacts is retained in a field-free region, and folding a portion of the arcing current at each of the coaxial electrode assemblies back upon itself to minimize any azimuthal field external to the coaxial electrode assemblies.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
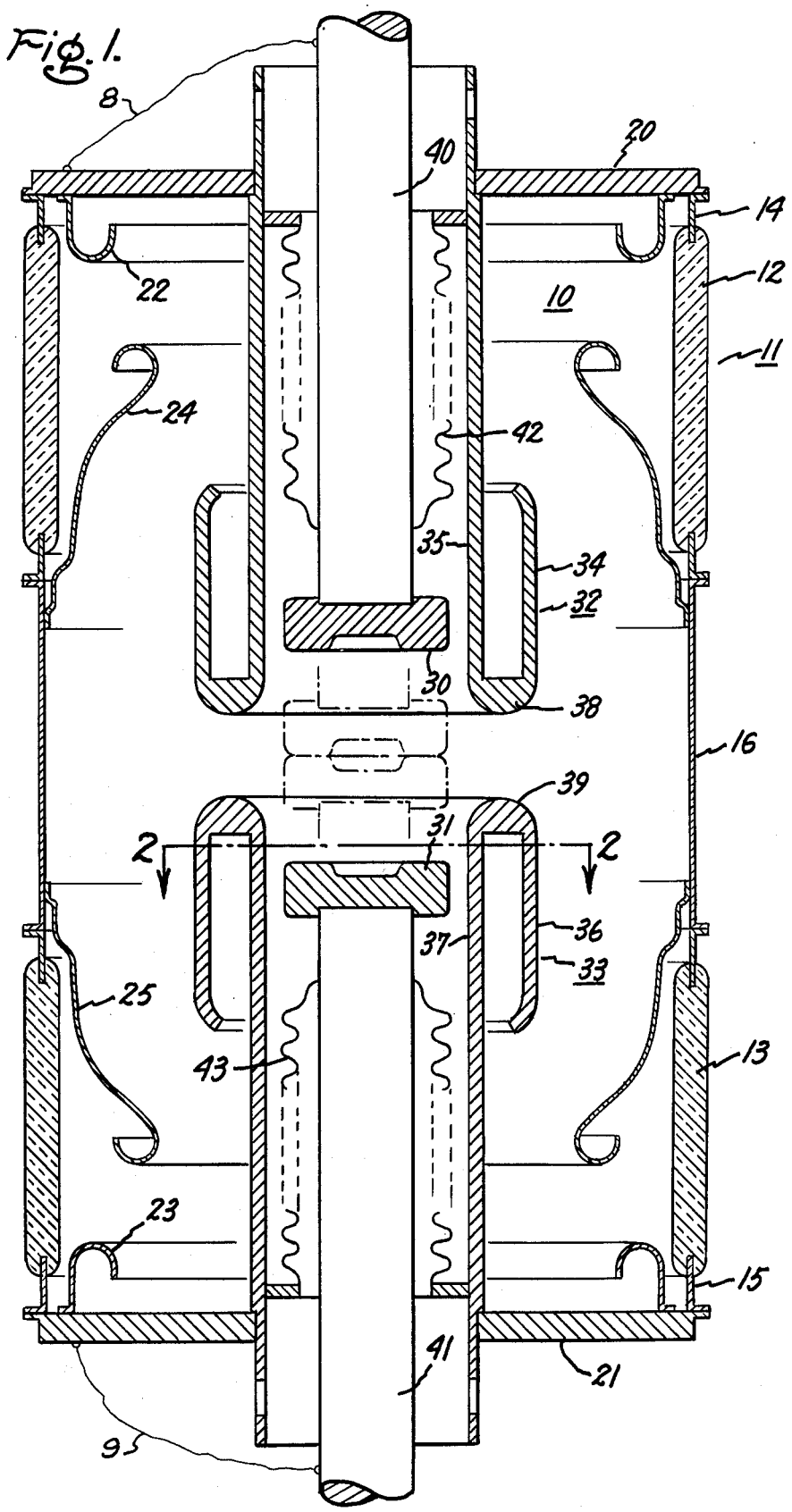
FIG. 1 is a longitudinal, sectional, schematic illustration of a vacuum arc discharge device constructed in accordance with a first embodiment of the invention showing, in phantom, location of the butt contacts when the device is in its normal current-conducting state.

FIG. 1 illustrates a vacuum arc discharge device which comprises a vacuum switch type of vacuum interrupter constructed in accordance with the teachings of the invention. Thus vacuum switch 10 comprises an envelope 11, the interior of which is evacuated of gas. Envelope 11 comprises insulating side wall members 12 and 13, such as glass, hermetically sealed to metallic flanges 14 and 15, respectively. The opposite ends of insulating side wall members 12 and 13 are hermetically sealed to a metallic side wall member or midband 16. Flange 14 is hermetically sealed to a first metallic end wall 20, while flange 15 is hermetically sealed to a second metallic end wall 21. Metallic shield members 22, 23, 24 and 25 prevent molten metal particles and/or metal vapor emitted in the arcing region from adhering to, and electrically short-circuiting insulating side wall members 12 and 13. In addition, shield members 22 and 23 serve to relieve voltage stresses at the glass-to-metal seals of flanges 14 and 15, respectively, by grading the electric field threat. Shield members 24 and 25 are welded or otherwise affixed to metallic side wall member 16, while shield members 22 and 23 are welded or otherwise connected to end walls 20 and 21, respectively. The shields and end walls are typically comprised of stainless steel.

When a voltage is to be interrupted by a vacuum switch, it is necessary to separate the butt contacts by a sufficient distance to prevent the arc from reestablishing itself directly between each of the butt contacts after arc extinction. This distance becomes larger as interruption voltages become higher, making the time necessary to achieve sufficient separation very critical to proper operation of the device at higher interruption voltages. Separation time can be essentially halved if both butt contacts are retractable, rather than one as in the more commonly-employed type of device. Additionally, each butt contact 30 and 31 of FIG. 1 is made retractable.

In the aforementioned Crouch et al. U.S. Pat. No. 3,914,568, a vacuum switch in which each of the primary electrodes is retractable into a respective shielding electrode is described and claimed. In the present invention, both contacts 30 and 31 are retractable into high dielectric strength shields 32 and 33, respectively, each shield being constructed of a pair of coaxial walls 34 and 35, and 36 and 37, respectively, each pair of coaxial walls being interconnected at one end through a lip structure 38 and 39, respectively. Shields 32 and 33 may comprise copper, Vascomax maraging alloy (available from VASCO, Latrobe, Pa.), or any gas-free cold cathode electrode material.

Figure 2:
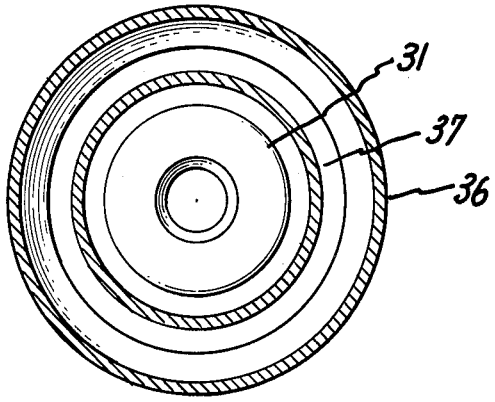
FIG. 2 is a sectional view along line 2—2 in FIG. 1.

Butt contacts 30 and 31, which typically are comprised of well-known contact materials such as copper-bismuth, copper-beryllium, etc. are supported by stems 40 and 41, respectively, typically comprised of copper which may be reinforced with a steel core or steel cladding. A first bellows assembly 42, hermetically sealed at one end to the inner side of inner coaxial wall 35 and at the other end to electrode stem 40, serves to maintain vacuum integrity within envelope 11 while permitting reciprocal movement of stem 40. Similarly, a second bellows assembly 43, hermetically sealed at one end to the inner side of inner coaxial wall 37 and at the other end to electrode stem 41 also serves to maintain vacuum integrity within envelope 11 while permitting reciprocal movement of stem 41. Each of electrode stems 40 and 41 is connected to end walls 20 and 21, respectively, through flexible conductors 8 and 9, respectively. The relative axial location of coaxial walls 36 and 37 with respect to butt contacts 31 is illustrated in FIG. 2, which is a sectional view taken along line 2—2 in FIG. 1.

In normal operation, butt contacts 30 and 31 are in abutting relationship, as indicated in phantom in FIG. 1, carrying normal load current. When an overload condition occurs, contacts 30 and 31 are ultimately withdrawn into the regions enclosed by coaxial shields 32 and 33, respectively, which are field-free regions. When contacts 30 and 31 start to separate, an electric arc is struck in the gap between the contacts. When the contacts have separated a sufficient distance, the arc transfer to the fixed gap electrode structure comprised of coaxial electrode assemblies 32 and 33. This structure is specifically designed to carry large arcing currents without suffering damage.

In the fixed gap electrode structure, the arcing current path is folded back on itself so as to reduce the azimuthal magnetic field external to order coaxial electrode surfaces 34 and 36 due to current flow through inner coaxial electrode walls 35 and 37. By thus folding the current path back upon itself through walls 34 and 36 of the fixed gap structure, the arc tends to burn in a diffuse mode over a greatly enlarged electrode surface area extending over the outer surface of coaxial wall interconnections 38 and 39 and substantially the entire outer cylindrical surface of outer coaxial electrode walls 34 and 36. Additionally, concentration of the arc on the lip of the fixed gap structure (i.e. regions 38 and 39) is avoided, as is consequential early melting of the coaxial electrodes in this region.

The high voltage withstanding capability of the device of FIG. 1, after arc extinction following current zero, is enhanced by retracting movable contacts 30 and 31 into the approximately field-free regions surrounded by coaxial electrode assemblies 32 and 33, respectively. Added voltage withstanding capability is obtained due to the approximately uniform separation between the curved distal ends of outer coaxial electrode walls 34 and 36 and metal vapor shields 24 and 25, respectively, which avoids excessively high field intensities therebetween.

While the movable contact assembly in vacuum switch 10 is "double-ended" in that both contacts 30 and 31 are movable, it is possible to employ one fixed contact and one movable contact in the device. Nevertheless, with sufficiently large gap spacings required for high voltage interruption, the simultaneous withdrawal of both contacts from a closed position is advantageous in that the gap opening time is halved. For lower voltage interruption, the desirability of employing a "double-ended" movable contact assembly is not as great.

Figure 3:
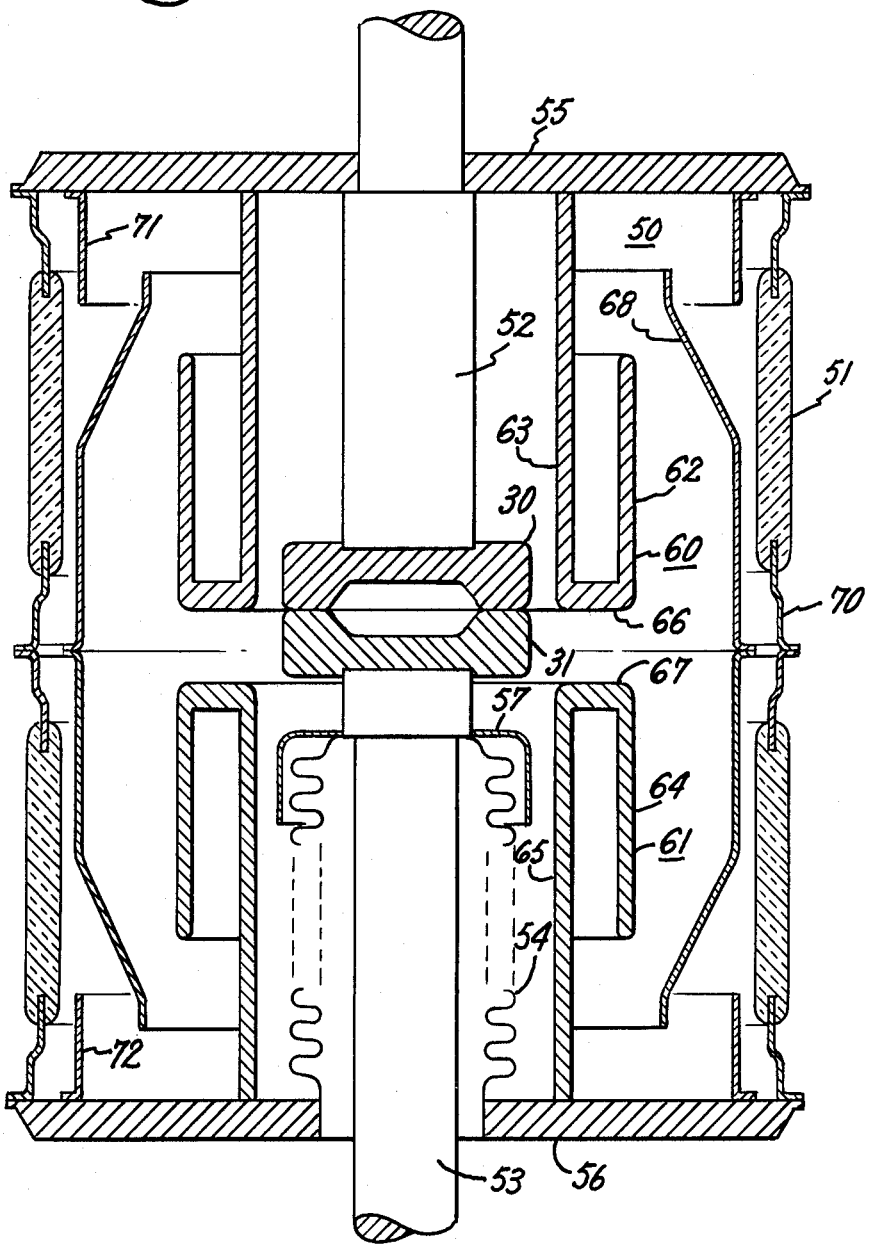
FIG. 3 is a longitudinal, sectional, schematic illustration of a vacuum arc discharge device of less complexity and slightly reduced voltage interruption capability than the device shown in FIGS. 1 and 2.

FIG. 3 illustrates another embodiment of the invention wherein a vacuum switch 50 having symmetrical, coaxial, fixed gap electrodes comprises an envelope 51, the interior of which is evacuated of gas. Envelope 51 comprises side wall members and metallic end walls of construction substantially similar to that of the device shown in FIG. 1. Butt contacts 30 and 31 are shown in an aubtting relationship, with support electrodes 52 and 53 therefor, respectively. Support electrode 52 is rigidly attached to end wall 55, since the device is intended for lower interruption voltage applications than the device of FIG. 1. A bellows 54 is attached at one end to movable support electrode 53 and, at the opposite end, to end wall 56. Support electrode 53 is connected to end wall 56 through a flexible conductor (not shown). A shield 57 attached to support electrode 53 partially encloses bellows 54 to protect it from bombardment by arc-generated metallic vapors or particles. Fixed contact 30 is contained in an approximately field-free region encircled by high dielectric strength coaxial electrode 60, while movable contact 31 is retractable into an approximately field-free region encircled by high dielectric strength coaxial electrode 61. Thus each of coaxial electrodes 60 and 61 is typically comprised of coaxial, cylindrical, walls 62 and 63, and 64 and 65, respectively, which may be fabricated, for example, of Vascomax alloy, copper, or any gas-free cold cathode electrode material, interconnected at one end by a lip structure 66 and 67, respectively.

In keeping with the lower interruption voltage capability of the vacuum switch of FIG. 3, by comparison to that of FIG. 1, outer coaxial walls 62 and 64 of coaxial, fixed gap electrode structures 60 and 61, respectively, are essentially cylindrical all the way out to the distal ends thereof. Because of the lower voltage requirements, the distal ends of metal vapor shield 68, which is joined to metallic midband 70 of envelope 51 as by welding, as well as the distal ends of electric field grading shields 71 and 72, are not curled, through such curls would enhance performance of the vacuum switch. The intent of omitting the curls is to achieve a device of lower manufacturing cost than that shown in FIGS. 1 and 2.

When contact 31 is retracted into the region enclosed by coaxial shield structure 61 during an overload current condition, an arc is struck in the gap between contacts 30 and 31 as contact 31 begins moving away from contact 30. When contact 31 has been retracted a sufficient distance, the arc transfers to the fixed gap electrode structure comprised of coaxial electrode assemblies 60 and 61, which is designed to carry large arcing currents without suffering damage. As with the device shown in FIG. 1, the fixed gap electrode structure is symmetrical and the current path in each coaxial electrode assembly is folded back on itself so as to reduce the aximuthal magnetic field external to outer coaxial walls 62 and 64. The folding back of the current path causes the arc to tend to burn in a diffuse mode over the outer surface of cylindrical walls 61 and 62, as well as over the outer surface of lip structures 66 and 67.

Figure 4:
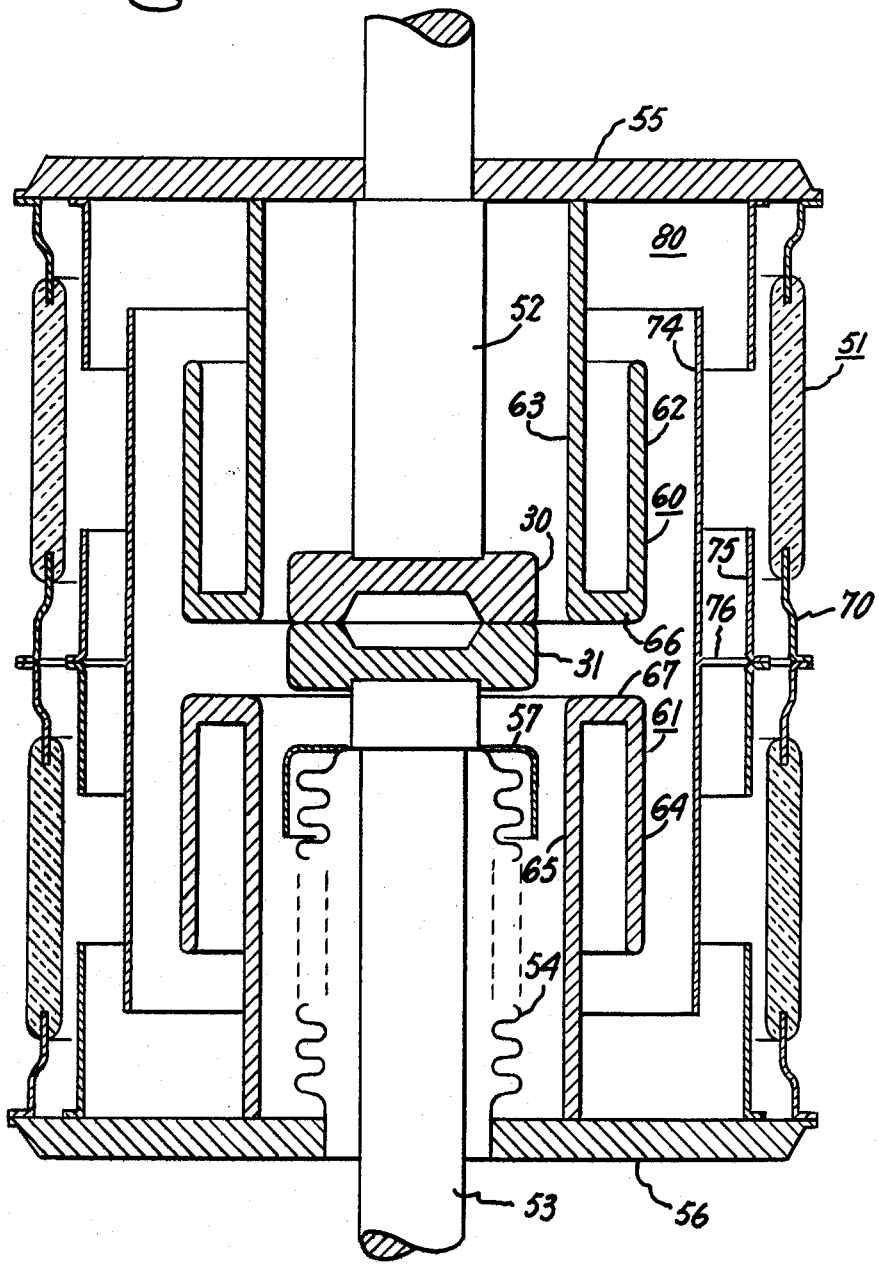
FIG. 4 is a longitudinal, sectional, schematic illustration of a vacuum arc discharge device of less complexity and slightly reduced voltage interruption capability than the device shown in FIG. 3.

FIG. 4 illustrates a vacuum switch having fixed gap electrodes and being of greater simplicity than the device shown in FIG. 3, but which exhibits a lower interruption voltage capability than the device shown in FIG. 3. Thus vacuum switch 80 is comprised of envelope 51, the interior of which is evacuated of gas. Butt contacts 30 and 31 are shown in an abutting relationship, with support electrodes 52 and 53 therefor, respectively, support electrode 52 being rigidly attached to end wall 55. A bellows 54 is attached at one end to movable support electrode 53 and at the other end to end wall 56, and is partially enclosed by shield 57. Support electrode 53 is electrically connected to end wall 56 through a flexible connector (not shown). Fixed contact 30 is contained in a field-free region encircled by high dielectric strength coaxial shield assembly 60, while movable contact 31 is retractable into an approximately field-free region encircled by high dielectric strength coaxial shield assembly 61. Each of coaxial electrodes 60 and 61 is typically comprised of coaxial, cylindrical walls 62 and 63, and 64 and 65, respectively, interconnected at one end by lip structure 66 and 67, respectively. Electrodes 60 and 61 may comprise copper, Vascomax alloy, or any gas-free cold cathode electrode material.

A metal vapor shield 74, of cylindrical configuration, encircles each of coaxial electrode assemblies 60 and 61, and extends axially beyond the ends of outer walls 62 and 64 of the coaxial electrode assemblies. A secondary metal shield 75 of cylindrical configuration encircles shield 74. Both shields 75 and 74 are electrically interconnected by a metallic disk support 76 affixed thereto, and to metallic midband 70, as by welding. Secondary metal shield 75 serves to relieve voltage stresses at the glass-to-metal seals at either end of metallic midband 70. Because the shields and coaxial electrodes of vacuum switch 80 are all of essentially cylindrical configuration (with the exception of lip structures 66 and 67 and a portion of shield 57), this device is of lower manufacturing cost than those of FIGS. 1 and 3.

When contact 31 is retracted into the region enclosed by coaxial shield structure 61 during an overload condition, an electric arc is struck in the gap between contacts 30 and 31 as contact 31 begins to separate from contact 30. When the contacts have separated a sufficient distance, the arc transfers from the gap between electrodes 30 and 31 to the space between vapor shield 74 and outer walls 62 and 64 of coaxial electrode assemblies 60 and 61, respectively. In this fashion, therefore, vapor shield 74 functions as an intermediate electrode, so that the diffuse arc burns between each of outer coaxial electrode walls 62 and 64 and vapor shield 74, as well as between the exterior surfaces of lip structures 66 and 67. Again, this diffuse mode occurs because of the folding back of the current path which takes place in the coaxial cylindrical electrode assembly.

Figure 5:
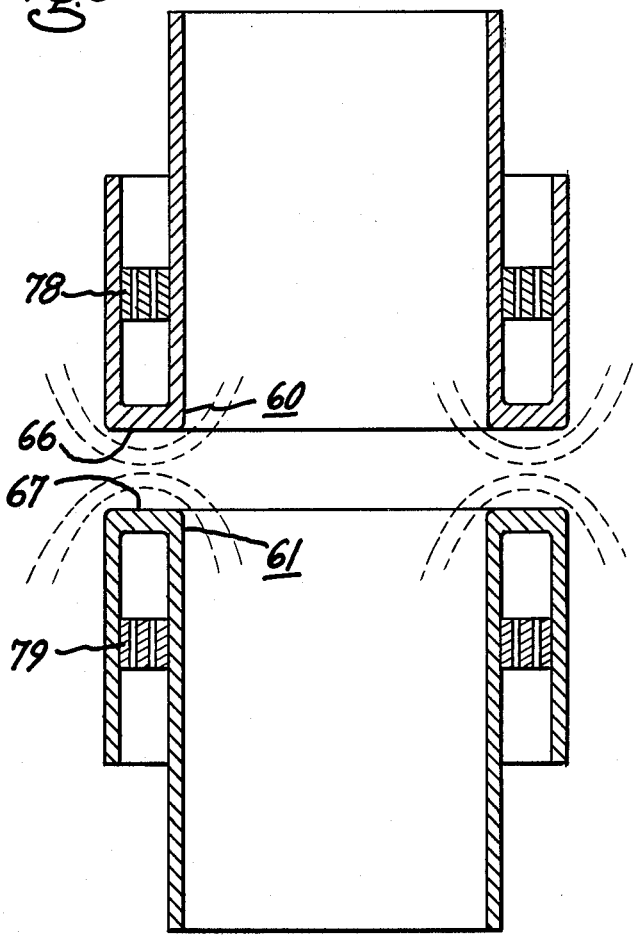
FIG. 5 is a longitudinal, sectional, schematic illustration of the fixed gap electrodes of a vacuum arc discharge device constructed in accordance with another preferred embodiment of the invention.

FIG. 5 is an illustration of coaxial electrode assemblies 60 and 61 of the type employed in the apparatus of FIGS. 3 and 4, with addition of conductive, magnetic field-forming, slotted annuli or disks 78 and 79 supported inside coaxial electrode assemblies 60 and 61, respectively, as by welding thereto. A typical disk, such as disk 78, is shown in plan view, in FIG. 6, as comprising elements or lands 83, 84 and 85 which connect regions 81A, 81B and 81C of an inner ring 81 to circumferentially-displaced regions 82A, 82B and 82C, respectively, of an outer ring 82. Regions 82A, 82B and 82C are advanced from the corresponding regions of inner ring 81 in a clockwise direction. It is evident that, if viewed from the opposite side, regions 81A, 81B and 81C of inner ring 81 would appear to be interconnected with circumferentially-displaced regions 82A, 82B and 82C, respectively, of outer ring 82 which would be advanced from the corresponding regions of inner ring 81 in a counterclockwise direction.

Figure 6:
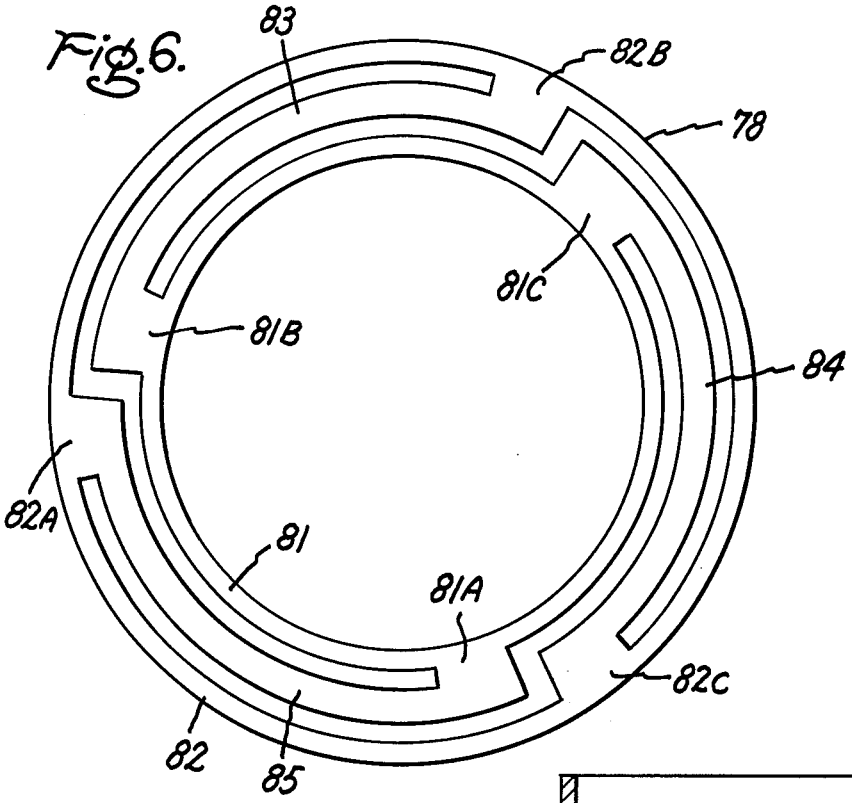
FIG. 6 is a plan view of a magnetic field-forming annulus employed in the apparatus shown in FIG. 5.

Annulus 78 comprises metal of greater electrical conductivity than that of the coaxial electrodes, e.g. copper, so as to form preferential current paths between the inner and outer electrode of each coaxial electrode assembly shown in FIG. 5, which may typically be comprised of steel. Thus current flow through disk 78, as shown in FIG. 6, tends to follow generally curved patterns which, flowing from inner ring 81 to outer ring 82, occur approximately in a clockwise direction and, flowing from outer ring 82 to inner ring 81, occur approximately in a counterclockwise direction. Viewed from the opposite side, however, these same current flow patterns would occur in opposite circumferential directions, respectively. Thus, in the coaxial electrode assemblies in FIG. 5, it is desirable to orient disks 78 and 79 such that current flow through disk 78 from the inner wall of coaxial electrode assembly 60 is generally in an opposite circumferential direction with respect to current flow through disk 79 from the outer wall of coaxial electrode assembly 61.

By including disks 78 and 79 in coaxial electrode assemblies 60 and 61, as shown in FIG. 5, the circumferential components of current in electrode assemblies 60 and 61 create a magnetic field with a strong radial component in the gap therebetween; that is, a cusp magnetic field is created, as indicated by dashed lines. This field then interacts with the arc current flow after the vacuum switch has reacted to a current overload condition by opening its butt contacts, causing the arc plasma to rotate about the outer walls of coaxial electrode assemblies 60 and 61. This rotation of the arc plasma is advantageous for at least two reasons. First, while the arc plasma is diffuse and generally uniform, it is not perfectly uniform. Hence rotating the plasma aids in smoothing out plasma non-uniformities. Second, if the arc current becomes sufficiently great, the threshold for anode spot formation will be attained, even though this threshold is very high. Anode spot formation occurs when the arc is sufficiently concentrated to cause melting of one or more separate regions on components within the vacuum switch envelope. Rotation of the constricted arc improves vacuum switch performance by moving the anode spot over the electrode surface instead of allowing it to concentrate at one location on the surface.

Figure 7:
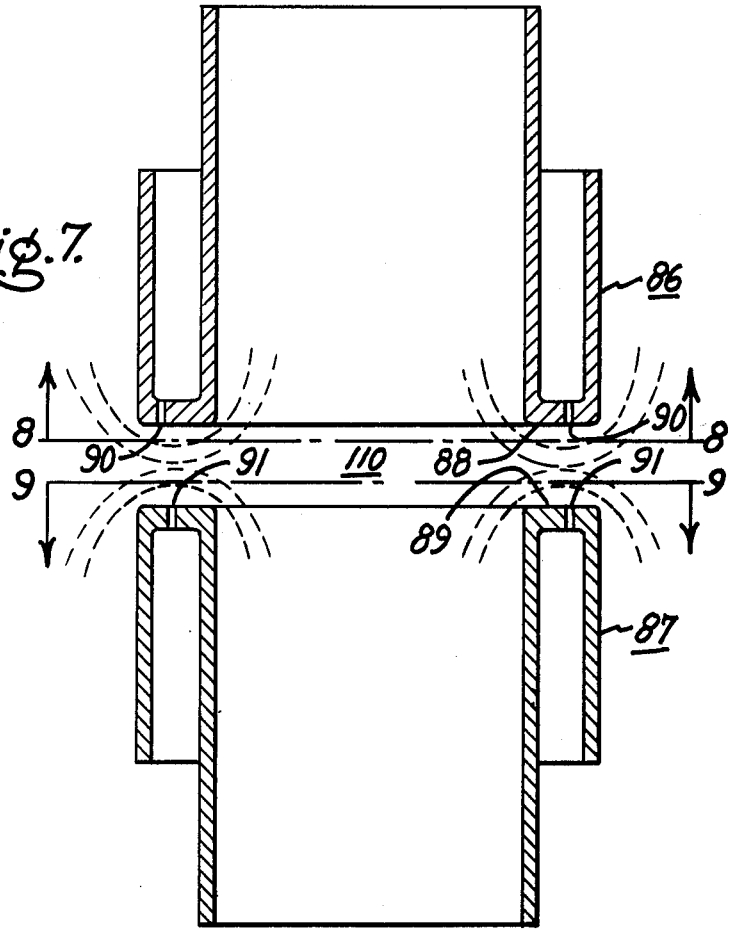
FIG. 7 is a longitudinal, sectional, schematic illustration of the fixed gap electrodes of a vacuum arc discharge device constructed in accordance with another embodiment of the invention.

FIG. 7 is a longitudinal, sectional, schematic diagram of another form of coaxial electrode assembly that may be used in the vacuum switch of the instant invention as, for example, switch 50 shown in FIG. 3. In this embodiment, in which only the coaxial electrodes are shown for simplicity, each of lip structures 88 and 89 of coaxial electrode assemblies 86 and 87, respectively, is slotted in predetermined fashion through its entire thickness, so as to cause current flow between the inner and outer walls of the coaxial electrode assemblies to occur approximately in the manner described in conjunction with the apparatus of FIG. 5. Slots 90 and lip structure 88 are generally directed obliquely to slots 91 in lip structure 89. The orientation of slots 90 is better illustrated in FIG. 8, which is a view taken along line 8—8 in FIG. 7, while the orientation of slots 91 is better illustrated in FIG. 9, which is a view taken along line 9—9 in FIG. 7.

Figure 8:
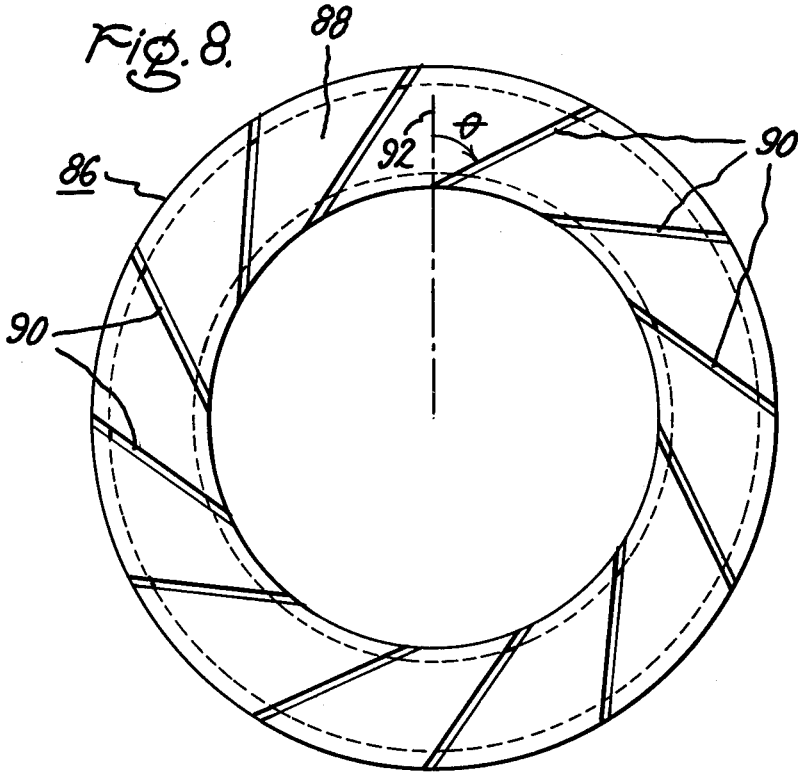
FIG. 8 is a view taken along line 8—8 in FIG. 7.
Figure 9:
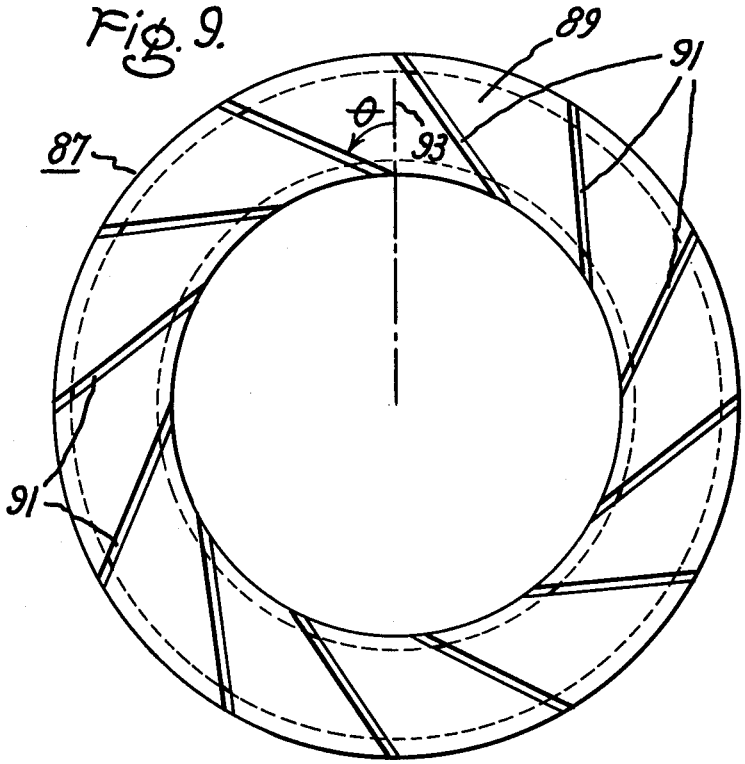
FIG. 9 is a view taken along line 9—9 in FIG. 7.

In FIG. 8, slots 90 are illustrated as deviating from radial direction 92 by an angle $\theta$ measured at the intersection of the innermost portion of slot 90 with the radial direction. Similarly, slots 91 are illustrated in FIG. 9 are deviating from radial direction 93 by angle $\theta$, measured at the intersection of the innermost portion of slot 91 with the radial direction. However, angle $\theta$ in FIG. 8 deviates from radius 92 of coaxial electrode assembly 86 in a clockwise direction, while angle $\theta$ in FIG. 9 deviates from radius 93 of coaxial electrode assembly 87 in a counterclockwise direction. Consequently, current flow from the inner to the outer wall of coaxial electrode assembly 86 occurs in a generally clockwise direction, and from the outer to the inner wall of coaxial electrode assembly 87 occurs in a generally counterclockwise direction. As a result of the circumferential components of current flow in coaxial electrode assemblies 86 and 87, a cusp magnetic field, indicated by dashed lines, is created in gap 110 between electrode assemblies 86 and 87, shown in FIG. 7. This results in rotation of the arc plasma in the manner described, supra, with its attendant benefits.

Figure 10:
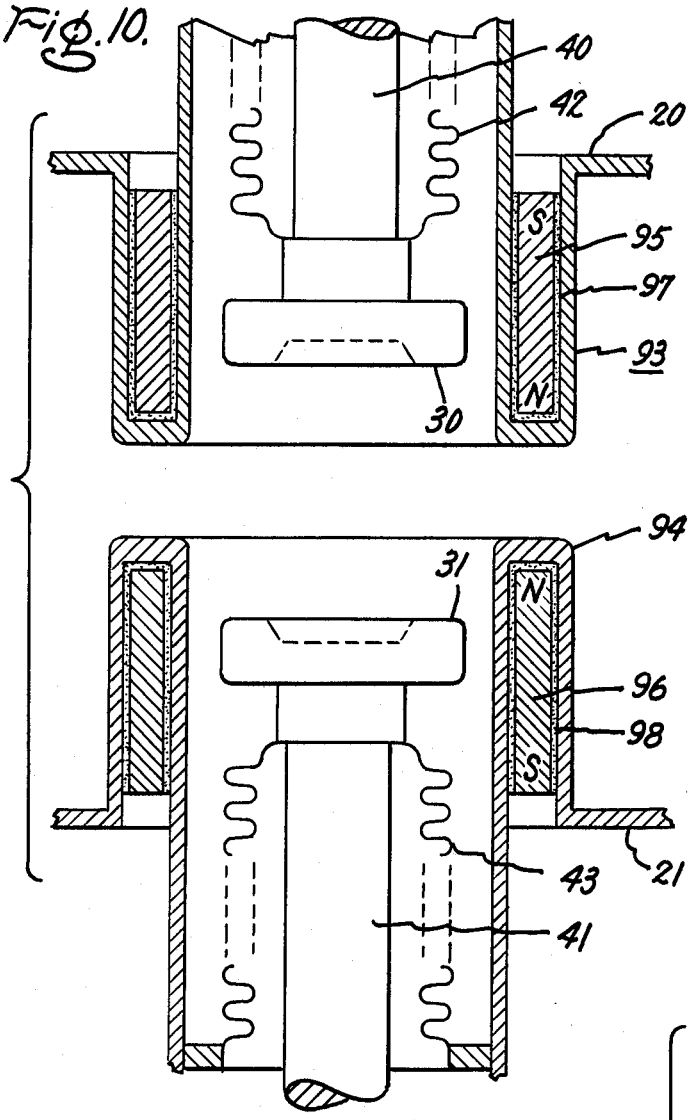
FIG. 10 is a longitudinal, sectional, schematic illustration of the fixed gap and movable electrodes of a vacuum arc discharge device constructed in accordance with another embodiment of the invention.

FIG. 10 is a longitudinal, sectional, schematic illustration of the fixed gap and movable electrodes of a vacuum switch of the type shown in FIG. 1, for example, wherein both butt contacts 30 and 31 are movable. In this embodiment, coaxial electrode assemblies 93 and 94 are comprised of nonmagnetic metal such as copper, for example, and the outer walls of coaxial electrode assemblies 93 and 94, into which movable contacts 30 and 31 are respectively retractable, are affixed to vacuum switch end walls 20 and 21, respectively. Generally cylindrical, permanent magnets 95 and 96 are inserted between the coaxial walls of electrode assemblies 93 and 94, respectively, and are retained in place within a pocket of electrical insulation 97 and 98, respectively, which may comprise, for example, a wire coating such as the polyester Alkanex, (a registered trademark of General Electric Company, Schenectady, N.Y.), a polyimide wire coating, or a ceramic sleeve. The permanent magnets are oriented with their like poles opposing each other so as to establish a magnetic field penetrating the nonmagnetic material of coaxial electrode assemblies 93 and 94 so as to create a cusp magnetic field therebetween (not shown) which acts to rotate the diffuse arc on the outer surfaces of the coaxial electrode assemblies in the manner described in conjunction with the apparatus of FIG. 5. The benefits of arc plasma rotation are thus obtainable with the apparatus shown in FIG. 10. Although the magnetic field in the apparatus of FIG. 10 is continually in existence, it has no significant effect on operation of the vacuum switch while butt contacts 30 and 31 are closed since, during that condition, no electric arc exists within the vacuum switch. Those skilled in the art will recognize that magnets 95 and 96 may be inserted into coaxial electrode assemblies 93 and 94, respectively, from the outside of the vacuum switch envelope, thus avoiding any necessity for deleteriously subjecting the magnetic material to the high temperature bake-out required for vacuum switch devices.

Figure 11:
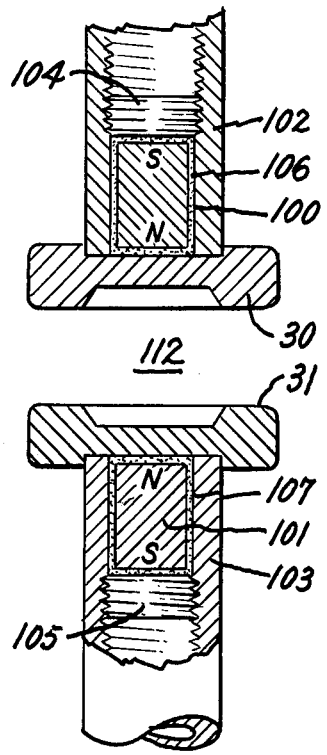
FIG. 11 is a longitudinal, sectional, schematic illustration of the movable electrodes of a vacuum arc discharge device constructed in accordance with another embodiment of the invention.

FIG. 11 is a longitudinal, sectional, schematic illustration of the movable gap electrodes of a vacuum switch, such as of the type shown in FIG. 1, for example. In this embodiment, however, each one of a pair of permanent magnets 100 and 101 is enclosed within a hollow electrode support structure 102 and 103, respectively, each of which structure may be internally threaded so as to permit an externally threaded metallic disk 104 and 105, respectively, to hold the permanent magnet in place. As in the apparatus shown in FIG. 10, each of the permanent magnets is contained in a pocket of electrical insulation 106 and 107, respectively, so as to prevent damage to the magnet caused by electrical resistance heating thereof.

Magnets 100 and 101 are oriented such that their like poles are opposed. Contacts 30 and 31 are fabricated of the materials mentioned in conjunction with the apparatus shown in FIG. 1, so as to permit the magnetic flux produced by magnets 100 and 101, respectively, to extend outward beyond contacts 30 and 31. Consequently, a cusp magnetic field (not shown) is created in gap 112 between contacts 30 and 31 during current overload conditions, when the contacts are opened, and the arc on the fixed gap coaxial electrodes (not shown) is advantageously caused to rotate on the outer surfaces thereof. In this embodiment, very little repulsion force is exerted on contacts 30 and 31 when the device is in normal operation and contacts 30 and 31 are conducting normal load current, since the magnets are separated from each other by a distance equal to the total maximum thickness of contacts 30 and 31 plus the total thickness of insulation 100 and 101. Magnets 100 and 101 may be inserted into electrode supporrt structures 102 and 103 from outside the vacuum switch, thus avoiding any necessity for subjecting the magnetic material to high-temperature bake-out in the vacuum switch fabrication process.

The foregoing describes a compact vacuum switch capable of withstanding high interruption voltage. The vacuum switch has a fixed gap electrode structure in which the arc tends to burn in a diffuse mode over a large portion of the electrode surface area. The vacuum switch is capable of producing a magnetic field having a radial component in the gap region of sufficient strength to rotate arc plasma in the gap.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. A vacuum arc discharge device comprising:

a hermetically sealed evacuated envelope having first and second opposed, conductive end walls;

first and second central butt contacts, said contacts abutting each other when carrying normal load current, said first contact being retractable toward said first end wall and being electrically connected thereto, and said second contact being electrically connected to said second end wall; and first and second electrode assemblies being coaxially situated about said first and second butt contacts, respectively, and being electrically connected to said first and second end walls, respectively, each of said electrode assemblies including a pair of coaxial walls and conductive means interconnecting said coaxial walls at their innermost ends, said first butt contact being retractable into the region enclosed by the inner coaxial wall of said first electrode assembly, respectively, said first and second electrode assemblies being fixedly separated from each other by a predetermined distance.

2. The apparatus of claim 1 wherein said second butt contact is retractable toward said second end wall and into the region enclosed by the inner coaxial wall of said second electrode assembly.

3. The apparatus of claim 1 including a cylindrical metal vapor shield coaxially surrounding said first and second electrode assemblies at a predetermined spacing therefrom and being electrically isolated from said end walls.

4. The apparatus of claim 1 wherein said electrode assemblies are comprised of nonmagnetic metal, and further including a cylindrical permanent magnet situated between the inner and outer coaxial wall of each of said first and second electrode assemblies, respectively.

5. The apparatus of claim 1 including permanent magnet means situated closely adjacent each of said butt contacts and being coaxial therewith.

6. The apparatus of claim 1 wherein said conductive means in each of said electrode assemblies comprises means electrically connecting the inner one of said coaxial walls at a first region to the outer one of said coaxial walls at a second region circumferentially displaced from said first region by a predetermined amount.

7. The apparatus of claim 6 wherein each of said means electrically connecting the inner one of said coaxial walls to the outer one of said coaxial walls comprises a surface having slots therein, said slots in said first electrode assembly being directed to deviate in a clockwise direction from radii of said first electrode assembly intersecting the radially innermost portion of said slots therein and, in said second electrode assembly, being directed to deviate in a counterclockwise direction from radii of said second electrode assembly intersecting the radially innermost portion of said slots therein.

8. The apparatus of claim 6 wherein each of said means electrically connecting the inner one of said coaxial walls to the outer one of said coaxial walls comprises a slotted disk containing lands, each land in said disk extending from a region near the innermost edge of said disk to a region near the outermost edge of said disk.

* * * * *